US012680273B2

(12) United States Patent
Wei

(10) Patent No.: US 12,680,273 B2
(45) Date of Patent: Jul. 14, 2026

(54) SYSTEMS AND METHODS FOR IDENTIFYING IMPROPER IMPLEMENT INSTALLATION

(71) Applicant: Caterpillar Inc., Peoria, IL (US)

(72) Inventor: Mo Wei, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 264 days.

(21) Appl. No.: 18/481,279

(22) Filed: Oct. 5, 2023

(65) Prior Publication Data

US 2025/0116093 A1 Apr. 10, 2025

(51) Int. Cl.
*E02F 9/22* (2006.01)
*E02F 9/26* (2006.01)

(52) U.S. Cl.
CPC ..... *E02F 9/226* (2013.01); *E02F 9/267* (2013.01)

(58) Field of Classification Search
CPC ..... E02F 9/226; E02F 9/267; E02F 9/265
See application file for complete search history.

(56) References Cited

U.S. PATENT DOCUMENTS 6,728,619 B2 4/2004 Adachi et al.
6,898,502 B2 5/2005 Watanabe et al.
6,990,390 B2 1/2006 Groth et al.
11,434,624 B2 9/2022 Tsukamoto
2008/0087163 A1* 4/2008 Brickner ..... F15B 21/087 91/369.2
2009/0198409 A1* 8/2009 Rector ..... G07C 5/085 701/33.4
2011/0313625 A1 12/2011 Miller et al.
2014/0129035 A1* 5/2014 Marquette ..... B62D 5/075 700/282
2016/0016174 A1* 1/2016 Sjoberg ..... B02C 2/047 241/211
2019/0024347 A1* 1/2019 Izumikawa ..... E02F 9/264
(Continued)

FOREIGN PATENT DOCUMENTS

EP 2207969 B1 * 12/2012 ..... F15B 21/08
EP 2774681 A1 * 9/2014 ..... B02C 2/04
(Continued)

OTHER PUBLICATIONS

Written Opinion and International Search Report for Int'l. Patent Appln. No. PCT/US2024/046104, mailed Dec. 10, 2024 (13 pgs).

*Primary Examiner* — Kito R Robinson
*Assistant Examiner* — Alexander V Gentile

(57) ABSTRACT

A system for identifying an improper implement on a machine includes a machine configured for performing one or more tasks, the machine including: a movable link configured to change a position of an implement installed on the machine; a hydraulic system for moving the link, the hydraulic system including a hydraulic valve and a hydraulic pump; and a pressure sensor configured to detect a pressure of hydraulic fluid for the hydraulic system and output a signal according to the detected pressure. The system further includes a controller configured to receive the signal from the pressure sensor, determine that the implement is improper due to being oversized, overweight, undersized or underweight, based on the signal from the pressure sensor, and generate a notification in response to determining that the implement is improper.

20 Claims, 6 Drawing Sheets

(56) References Cited

U.S. PATENT DOCUMENTS

| | | | | |
|---|---|---|---|---|
| 2020/0141091 | A1* | 5/2020 | Narikawa | E02F 3/435 |
| 2021/0002851 | A1 | 1/2021 | Morita | |
| 2021/0002852 | A1 | 1/2021 | Nishi | |
| 2024/0117594 | A1* | 4/2024 | Schmidt | E02F 9/265 |
| 2024/0368855 | A1* | 11/2024 | Thompson | E02F 9/265 |

FOREIGN PATENT DOCUMENTS

| | | | | | |
|---|---|---|---|---|---|
| JP | 07268902 | A | | 10/1995 | |
| JP | 2000144790 | A | | 5/2000 | |
| JP | 2014101664 | A | * | 6/2014 | E02F 3/435 |
| JP | 2017008524 | A | | 1/2017 | |
| KR | 1019950032926 | A | | 12/1995 | |

* cited by examiner

SYSTEMS AND METHODS FOR IDENTIFYING IMPROPER IMPLEMENT INSTALLATION

TECHNICAL FIELD

This disclosure relates generally to monitoring one or more aspects of an implement for a machine, and more particularly, to systems and methods for identifying the installation of an improper implement.

BACKGROUND

Machine systems are used in many applications, including earthmoving, paving, mining, drilling, forestry, and others. These machine systems can include implements for performing work, including buckets, blades, rippers, or cold planers, to name a few examples. Some implements are replaceable. While sometimes an implement is replaced with a new implement that is identical to the original for replacing a worn or damaged part, in some situations the new implement is different in size or in function. Thus, a replacement implement can provide different functionality, increased capacity, or effect other changes. While replaceable implements provide numerous advantageous to the machine, there is a possibility that an improper implement can be installed. Examples of improper implements include oversized implements, overweight implements, and implements that perform functions outside of the intended use of the machine. Incorrect installation of a suitable implement can also be considered an "improper" implement.

The installation of an improper implement can cause problems with the machine. For example, an implement that is oversized, overweight, or both, places increased strain on the machine. This can lead to accelerated wear or damage to one or more components of the machine. In some examples, the installation of an improper implement can impact machine performance or even pose risks to the operator or the machine.

An exemplary system for changing the function of a work machine is described in U.S. Pat. No. 6,898,502 B2 ("the '502 patent") to Watanabe et al. The system described in the '502 patent receives a key pad entry or information from a tag that indicates the change of a tool of a hydraulic excavator. Updates are provided via communication with a base station to change the functions of the excavator. While the system described in the '502 patent may be helpful for changing implements and re-programming a controller, it might not be able to identify an improperly installed implement, in particular during normal operation of the machine and/or without the use of vision sensors.

The techniques of this disclosure may solve one or more of the problems set forth above and/or other problems in the art. The scope of the current disclosure, however, is defined by the attached claims, and not by the ability to solve any specific problem.

SUMMARY

According to one aspect of the disclosure, a system for identifying an improper implement on a machine includes a machine configured for performing one or more tasks, the machine including: a movable link configured to change a position of an implement installed on the machine; a hydraulic system for moving the link, the hydraulic system including a hydraulic valve and a hydraulic pump; and a pressure sensor configured to detect a pressure of hydraulic fluid for the hydraulic system and output a signal according to the detected pressure. The system further includes a controller configured to receive the signal from the pressure sensor, determine that the implement is improper due to being oversized, overweight, undersized or underweight, based on the signal from the pressure sensor, and generate a notification in response to determining that the implement is improper.

According to another aspect of the disclosure, a detection system configured to determine presence of an improper implement includes a pressure sensor configured to detect a pressure of hydraulic fluid for controlling an implement and output a signal indicative of the pressure. The system further includes a controller configured to receive the signal from the pressure sensor, determine that the implement is improper due to being oversized, overweight, or oversized and overweight, based on the signal from the pressure sensor, and generate a notification in response to determining that the implement is improper.

According to yet another aspect of the disclosure, a method for identifying installation of an improper implement on a machine includes detecting a position of a movable link for positioning an implement with a position sensor, and determining a position of the implement based on the position of the movable link. The method further includes detecting a pressure of hydraulic fluid, flow of the hydraulic fluid being controlled for positioning the implement, and based on the determined position and the detected pressure, identifying an improper implement installed on the machine.

It is to be understood that both the foregoing general description and the following detailed description are exemplary and explanatory only and are not restrictive of the disclosed embodiments, as claimed.

BRIEF DESCRIPTION OF THE DRAWINGS

The accompanying drawings, which are incorporated in and constitute a part of this specification, illustrate various exemplary embodiments and together with the description, serve to explain the principles of the disclosure.

DETAILED DESCRIPTION

Both the foregoing general description and the following detailed description are exemplary and explanatory only and are not restrictive of the features, as claimed. As used herein, the terms "comprises," "comprising," "having," including," or other variations thereof, are intended to cover a non-exclusive inclusion such that a method or apparatus that comprises a list of elements does not include only those elements, but may include other elements not expressly listed or inherent to such a method or apparatus. In this disclosure, relative terms, such as, for example, "about," "substantially," "generally," and "approximately" are used to indicate a possible variation of ±10% in the stated value or characteristic. As used herein, the phrase "based on" encompasses both "based entirely on" and "based at least on."

Figure 1A:
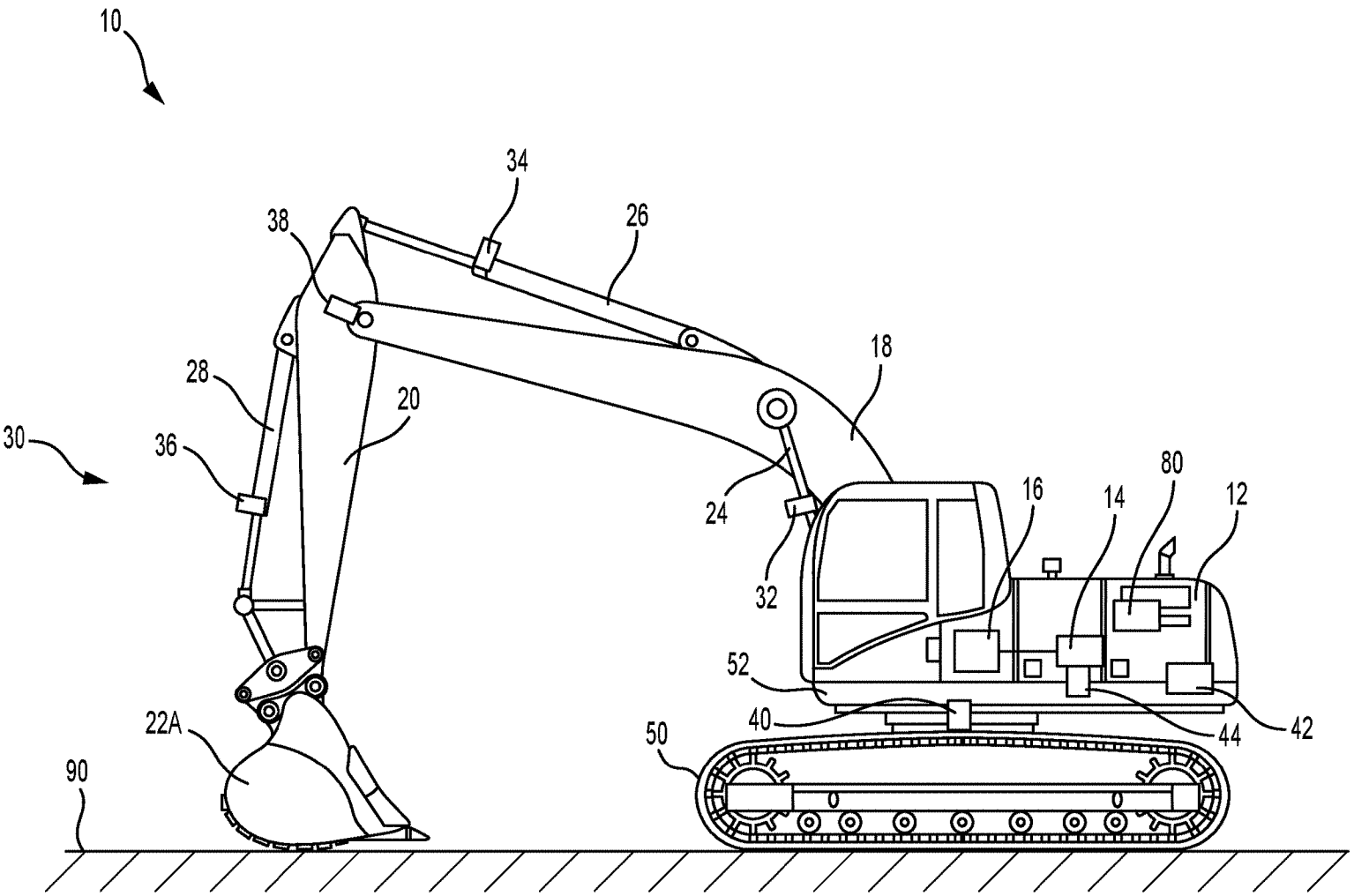
FIG. 1A is a partially-schematic side view of an exemplary machine and detection system for identifying an improper implement, according to aspects of the disclosure.

FIG. 1A is a side-view, schematic illustration showing a detection system 10 for identifying the installation of an improper implement. FIG. 1A illustrates an implement 22A installed on a machine 12. An example of an improper implement is shown in FIGS. 1B and 2B in the form of an oversized and overweight implement 22B.

Figure 1B:
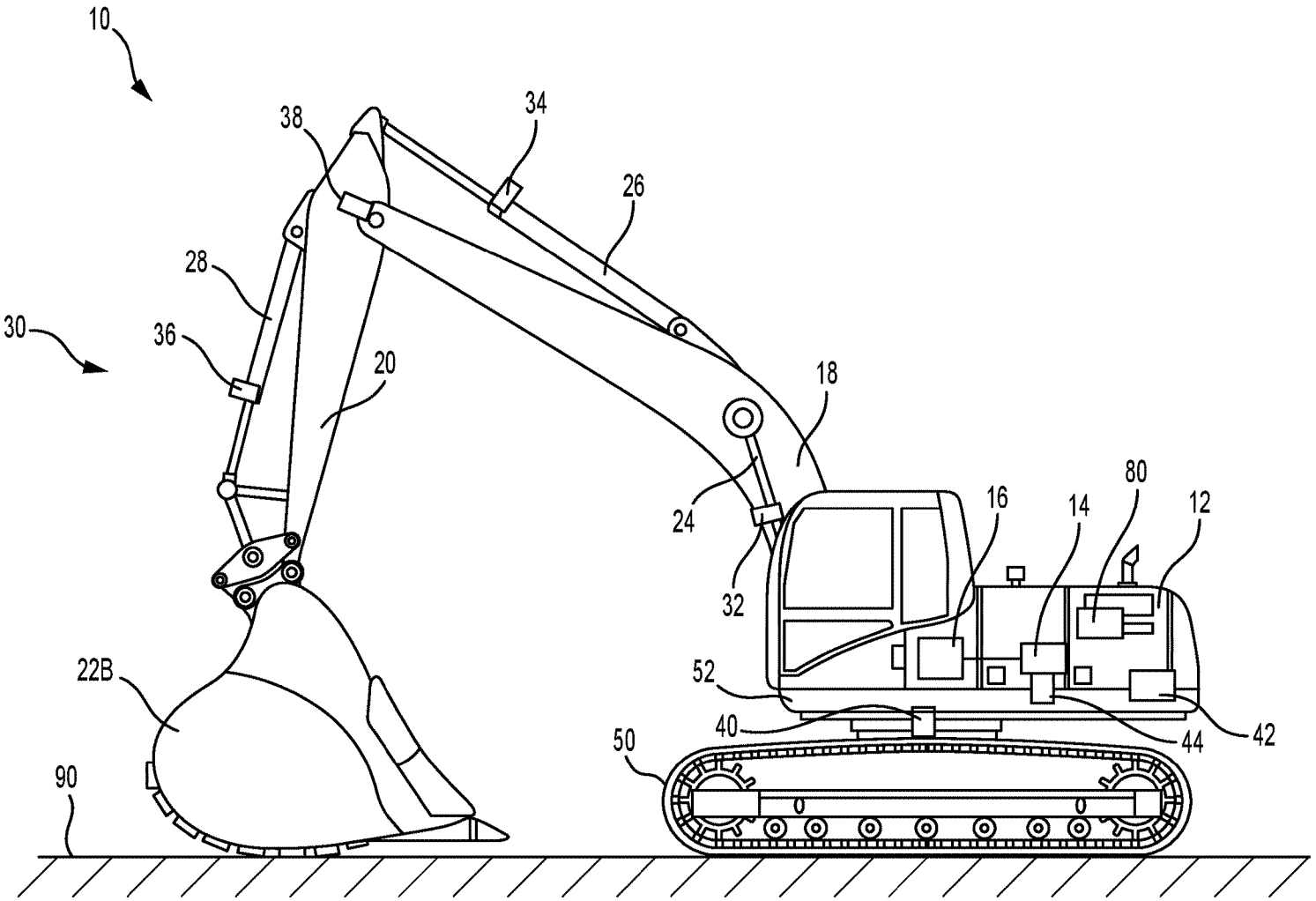
FIG. 1B is a partially-schematic side view of the machine and system of FIG. 1A, with an improper implement installed on the machine.

Implement 22A in FIGS. 1A and 1B is, for example, within the design criteria for machine 12. Machine 12 is designed for use with multiple implement sizes, and in some cases, multiple implement types. Thus, implement 22A may be within criteria (e.g., dimensions and weight) set for machine 12, while implement 22B is outside one or more of these criteria.

Figure 3:
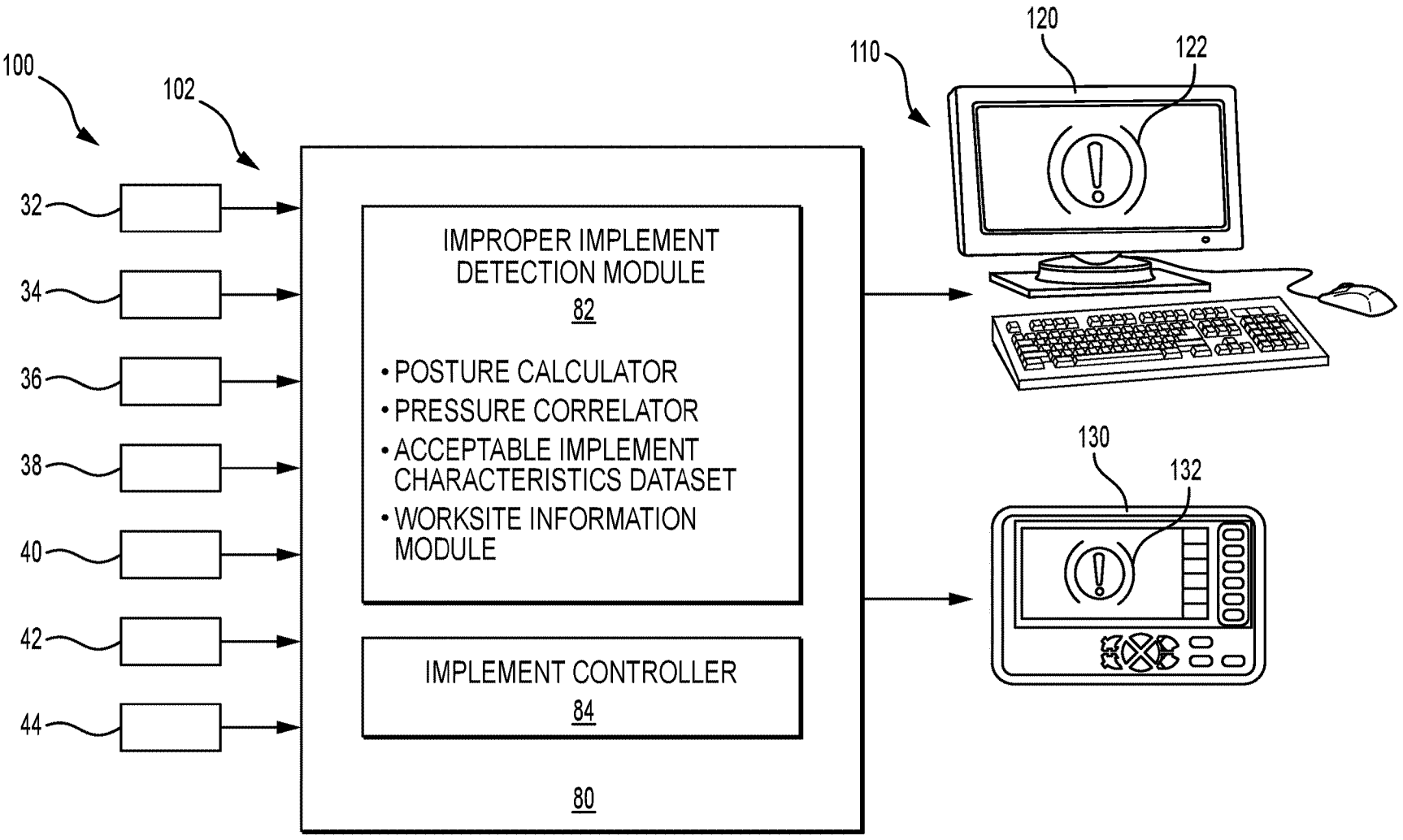
FIG. 3 is a block diagram of a controller for improper implement detection.

System 10 may include machine 12, a sensor system 30, and an electronic control module ("ECM") 80. If desired, system 10 may include one or more remote systems (e.g., system 120; FIG. 3) in communication with ECM 80 of machine 12 over one or more networks to facilitate monitoring of machine 12. ECM 80 may be configured to identify installation of an improper implement and, if desired, perform additional functions for machine 12 (e.g., control of an engine, control of an implement system, control of a transmission, control of a propulsion system, communication with one or more remote systems, and supervisory control of downstream controllers).

Machine 12 may be any machine that is configured for use with an implement, the implement being replaceable with one or more other implements having different sizes, different shapes, different functions, and/or different weights. Machine 12 may be an earthmoving machine, material movement machine (e.g., a crane), paving machine, drilling machine, or other type of machine, with an excavator being shown in FIGS. 1A-2B. Machine 12 may include one or more ground-engaging traction devices 50 and a frame 52.

In the example of an excavator, machine 12 includes a boom 18, a stick 20, and an implement 22A attached at an end of stick 20. The position of implement 22A is controlled by a hydraulic system that includes a boom cylinder 24, a stick cylinder 26, a bucket cylinder 28, and hydraulic pumps and valves, with a hydraulic pump 14 and a hydraulic valve 16 being shown in FIGS. 1A-2B. Implement 22A may therefore move in according with movement of one or more movable links, examples of movable links including boom 18 and stick 20. Other examples of moving links include the circle (or associated structure) of a motor grader, the lift arms of a loader, the dipper handle of a rope shovel, and the arms of a bulldozer, to name a few. Thus, the moving link may be any member that is directly or indirectly connected to an implement such that movement of the link results in movement in at least a portion of the implement relative to the frame of the machine.

FIGS. 1A, 1B, 2A, and 2B illustrate four exemplary postures of boom 18, stick 20, and implement 22A or 22B. In FIG. 1A, machine 12 is in a posture that places suitably-sized implement 22A in contact with the ground 90. An improperly-sized (e.g., oversized) implement 22B, when installed in the posture shown in FIG. 1B, results in boom 18 being higher in the air when implement 22B contacts ground 90, as compared to the position of boom 18 in FIG. 1A.

Machine 12 may include a propulsion system, including an internal combustion engine, generator, batteries, and/or fuel cell (not shown) for generating power to propel machine 12 and to control implement 22A via the hydraulic system. Ground-engaging traction devices, such as tracks or wheels and tires may facilitate movement of machine 12 at a worksite. Frame 52 may also rotate or swing relative to ground-engaging traction devices 50.

Boom 18 may be connected to a boom cylinder 24 such that actuation of boom cylinder 24 causes corresponding movement of boom 18. Stick 20 may be connected to a stick cylinder 26 such that actuation of stick cylinder 26 causes movement of stick 20. An implement cylinder 28 may, when actuated, cause movement of implement 22A about a pivot axis.

The hydraulic system of machine 12 may include one or more hydraulic pumps 14 that supply hydraulic fluid for actuating each cylinder 24, 26, and 28, and for swinging frame 52. The hydraulic system includes one or more hydraulic valves 16 may be configured to control flow of this hydraulic fluid. Pumps 14 and valves 16 may be controlled in accordance with commands generated with ECM 80.

Sensor system 30 may include one or more types of sensors such as position sensors, pressure sensors, flow sensors, force sensors, accelerometers, engine speed sensors, and others. In some aspects, some or all sensors of sensor system 30 are not vision sensors (also referred to herein as "non-vision" sensors) and thus, vision sensors are not required for detection of an improper implement. For example, every sensor used for detecting an improper implement, and if desired, every sensor connected to machine 12, may be a sensor other than a vision sensor. Examples of vision sensors include a camera (charge coupled devices, infrared cameras, etc.), a laser scanner, and distance-measuring devices such as LIDAR and radar. While some sensors of sensor system 30 are shown on the exterior of machine 12, including on the exterior of boom cylinder 24, stick cylinder 26, and implement cylinder 28, each sensor of sensor system 30 may be an internal sensor. These internal sensors may be located within the frame of machine 12 or incorporated on the interior of other components of machine 12, such as within cylinders 24, 26, and 28.

Sensors 32, 34, and 36 may include pressure sensors, position sensors, or both. Thus, sensors 32, 34, and 36 may be configured to generate signals that correspond to the pressure of hydraulic fluid and the position of cylinders 24, 26, and 28, respectively. Pressure signals from sensors 32, 34, and 36 may be received from ECM 80 to enable ECM 80 to determine instantaneous pressure of hydraulic fluid. From these instantaneous pressures, ECM 80 may determine a moving average or perform one or more other calculations to identify rapid and/or large changes in hydraulic pressure, as described below.

Position signals from sensors 32, 34, and 36 may be received from ECM 80, as described below, and may be sufficient to determine a position of an end of stick 20 at which implement 22A is connected, and accordingly, useful to determine an expected position of implement 22A. In examples where sensors of system 30 are internal sensors, sensors 32, 34, and 36 may be in-cylinder linear displacement transducers incorporated within boom cylinder 24, stick cylinder 26, and bucket cylinder 28.

Sensor system 30 may include one or more position sensors, such as rotary position sensors or devices having one or more accelerometers (e.g., an inertial measurement unit). One exemplary position sensor, sensor 38, is shown in FIGS. 1A-2B. Sensor 38 may be configured to detect the relative position of boom 18 to stick 20. Additional position sensors may include a sensor for measuring a position of boom 18 relative to frame 52 and a sensor for measuring a position of implement 22A relative to stick 20. As understood, these position sensors may be provided instead of sensors 32, 34, and 36. In at least some configurations, position sensors may be included in system 10 in addition to sensors 32, 34, and 36.

Swing sensor 40 may measure a rotational position of frame 52 as frame 52 rotates about a vertical axis and relative to ground-engaging traction devices 50. Swing sensor 40 may include one or more accelerometers (e.g., within an inertial measurement unit) or a rotary position sensor. Swing sensor 40 may, in combination with sensors 32, 34, and 36, and/or a plurality of position sensors, provide data that enables the determination of a position of implement 22A in three dimensions.

Sensor 42 may be configured to detect a characteristic of system 10 that is associated with an amount of energy used to move implement 22A and/or hold implement 22A at a stationary position. This energy may be necessary to operate the hydraulic system of machine 12. In examples where an internal combustion engine generates power for operating the hydraulic system, higher engine speeds may be correlated with increased work of the hydraulic system. In electric-based systems that employ fuel cells or batteries, higher amounts of electrical power may be correlated with increased amounts of work. Sensor 42 may be configured to generate a signal that corresponds to a measured engine speed of the internal combustion engine. In configurations where machine 12 is operated by a fuel cell and/or a battery system, sensor 42 may be configured to output a signal that indicates an amount of electrical energy consumed to move the installed implement 22A or 22B or hold implement 22A or 22B at a particular position.

ECM 80 may be programmed to control one or more aspects of system 10, including control of an implement in accordance with the operation of hydraulic components for the implement. As shown in FIGS. 1A-2B, ECM 80 may be configured to monitor and control position of a bucket. ECM 80 may also generate signals for electronic control of an internal combustion engine, electric motor, battery system, fuel cell, or other power-generating device. ECM 80 may encompass a single control unit that monitors for the installation of an incorrect implement, controls the propulsion (e.g., including an engine) system, and controls the hydraulic system, or separate control modules. In other embodiments, ECM 80 is distributed as a plurality of individual controllers. As used herein, a "controller" or "control module" encompasses both single control modules or a plurality of control modules. ECM 80 may be enabled, via programming, to receive signals from sensors of sensor system 30. When ECM 80 controls an implement, the programming for ECM 80 may enable ECM 80 to generate commands that control the flow of hydraulic fluid. In particular, ECM 80 may be configured, via programming, to receive signals that indicate a detected hydraulic fluid pressure and/or flow, and signals correlated with a position of an implement, and determine when an improper implement has been installed based on these received signals.

ECM 80 may embody a single microprocessor or multiple microprocessors that receive inputs and generate outputs. ECM 80 may include a memory, a secondary storage device, a processor such as a central processing unit, or any other means for accomplishing a task consistent with the present disclosure. The memory or secondary storage device associated with ECM 80 may store data and software to allow ECM 80 to perform its functions, including the functions described with respect to method 400. Numerous commercially available microprocessors can be configured to perform the functions of ECM 80. Various other known circuits may be associated with ECM 80, including signal filtering and analysis circuitry, command generation circuitry, communication circuitry, and other appropriate circuitry.

FIG. 3 is a block diagram illustrating an exemplary configuration of ECM 80. As shown in FIG. 3, ECM 80 may include an improper implement detection module 82 and an implement controller 84. Components of improper implement detection module 82 may include a posture calculator, a pressure correlator, an acceptable implement characteristics dataset, and a worksite information module. ECM 80 may be configured to receive inputs 100, including signals from sensors 32-44 of sensor system 30, and generate outputs 110, which may include outputs for components of machine 12 and/or outputs for one or more remote systems. Outputs 110 may include notifications generated by ECM 80 and displayed with a backend system 120 or an on-machine control system 130. Backend system 120 may include one or more systems at the same worksite as machine 12, or one or more systems located remotely (i.e., offsite). One or more networks (not shown), such as the internet, may facilitate communication between ECM 80 and backend system 120 in a known manner.

Backend system 120 may include a display configured to display notifications 122 based on information received from ECM 80. Backend system 120 may include one or more computer systems configured to monitor the performance at work at a worksite, monitor conditions and status of a fleet of machines, and one or more machines for remote control of one or more machines in a manual or autonomous manner. On-machine control system 130 may include a display for machine 12 (e.g., a display within a cabin of machine 12). On-machine control system 130 may assist with machine functions other than detection of an improper implement. For example, on-machine control system 130 may further be configured to present worksite information (e.g., tasks to be performed, a map, topographical information, etc.) and machine information (e.g., location of machine 12, status of fuel, electrical energy, temperature, etc.).

Inputs 100 for improper implement detection module 82 of ECM 80 may include signals 102, including signals from sensors 32, signals from sensors 34, and signals from sensors 36. Additionally or alternatively, inputs 100 may include signals from one or more position sensors 38. Inputs 100 may further include information from sensors for measuring a rotational position of implement 22A, such as swing sensor 40. Inputs 100 may also include signals from flow sensors and/or pressure sensors associated with one or more hydraulic pumps 14 and hydraulic valves 16. Finally, inputs 100, may include may include signals that indicate an amount of work associated with moving implement 22A and/or maintaining a position of implement 22A, such as sensor 42.

The posture calculator of improper implement detection module 82 may be configured to receive signals 102 from sensors 32, 34, and 36 to determine the posture of machine 12. The posture may be the position of an end of stick 20 and/or a position of implement 22. The posture calculator may use other information, such as positions detected with one or more position sensors 38 and swing sensor 40 to determine this posture, and any combination of these sensors may be suitable. In at least some examples, the posture calculator may receive implement commands from controller 84 and use these commands to calculate the posture of machine 12, instead of or in addition to signals 102 from sensors 32, 34, 36, 38, and 40.

The pressure correlator may allow improper implement detection module 82 to detect and monitor hydraulic pressure over time and correlate this pressure with a posture that was determined with the posture calculator. For example, the pressure correlation functions of module 82 include detecting an instantaneous pressure of hydraulic fluid (e.g., by one or more of sensors 32, 34, 36, and 44) and correlating this pressure with a predetermined maximum pressure threshold associated with the determined posture or with a predetermined maximum pressure threshold associated with performing a particular task. In addition or as an alternative, module 82 correlates detected pressure with a minimum pressure threshold associated with the current posture or with a current movement. Moving averages may be used, if desired, instead of or in addition to instantaneous pressure measurements.

Figure 2A:
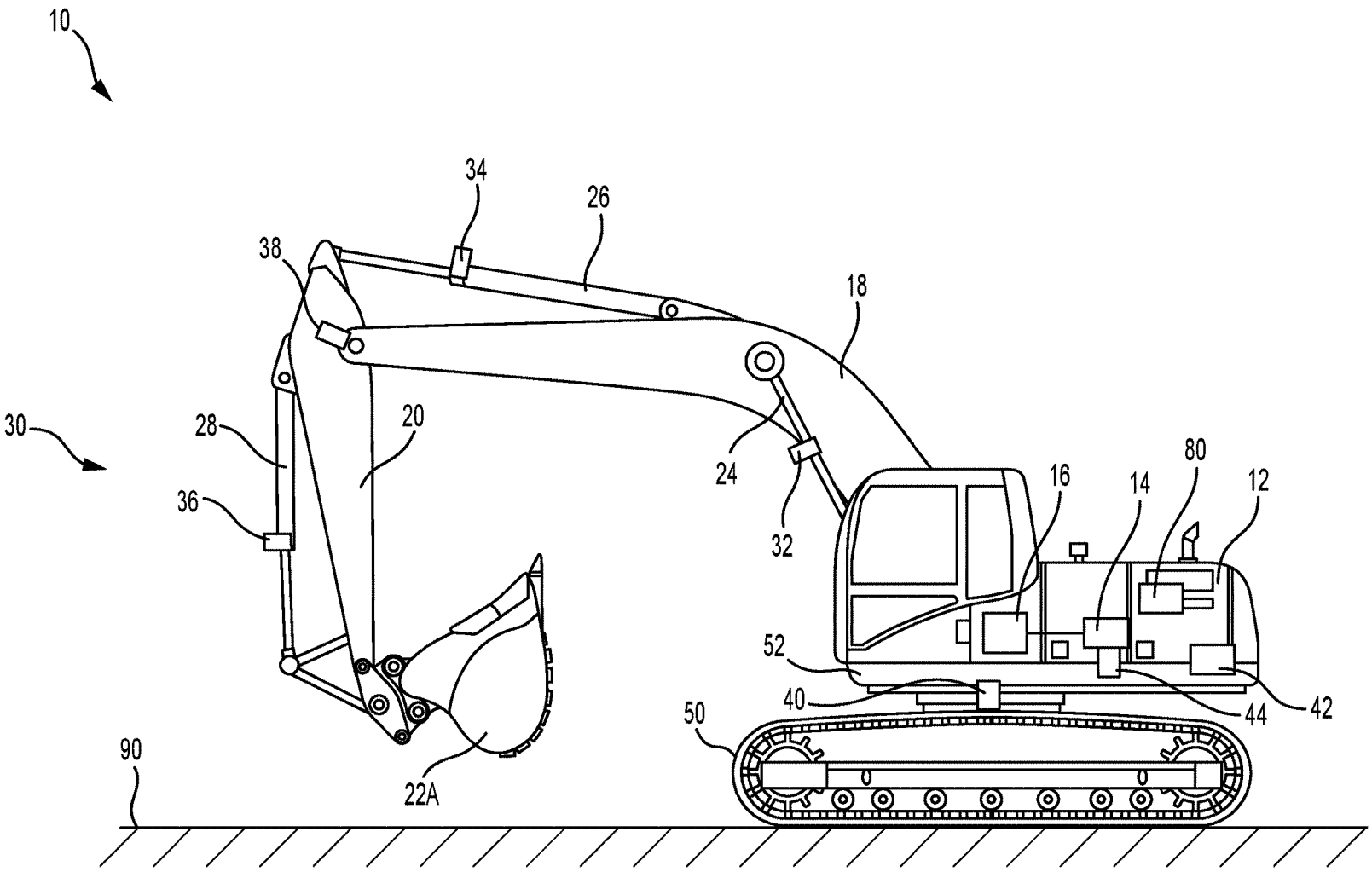
FIG. 2A is a partially-schematic side view of the machine and detection system of FIG. 1A in a different posture.
Figure 2B:
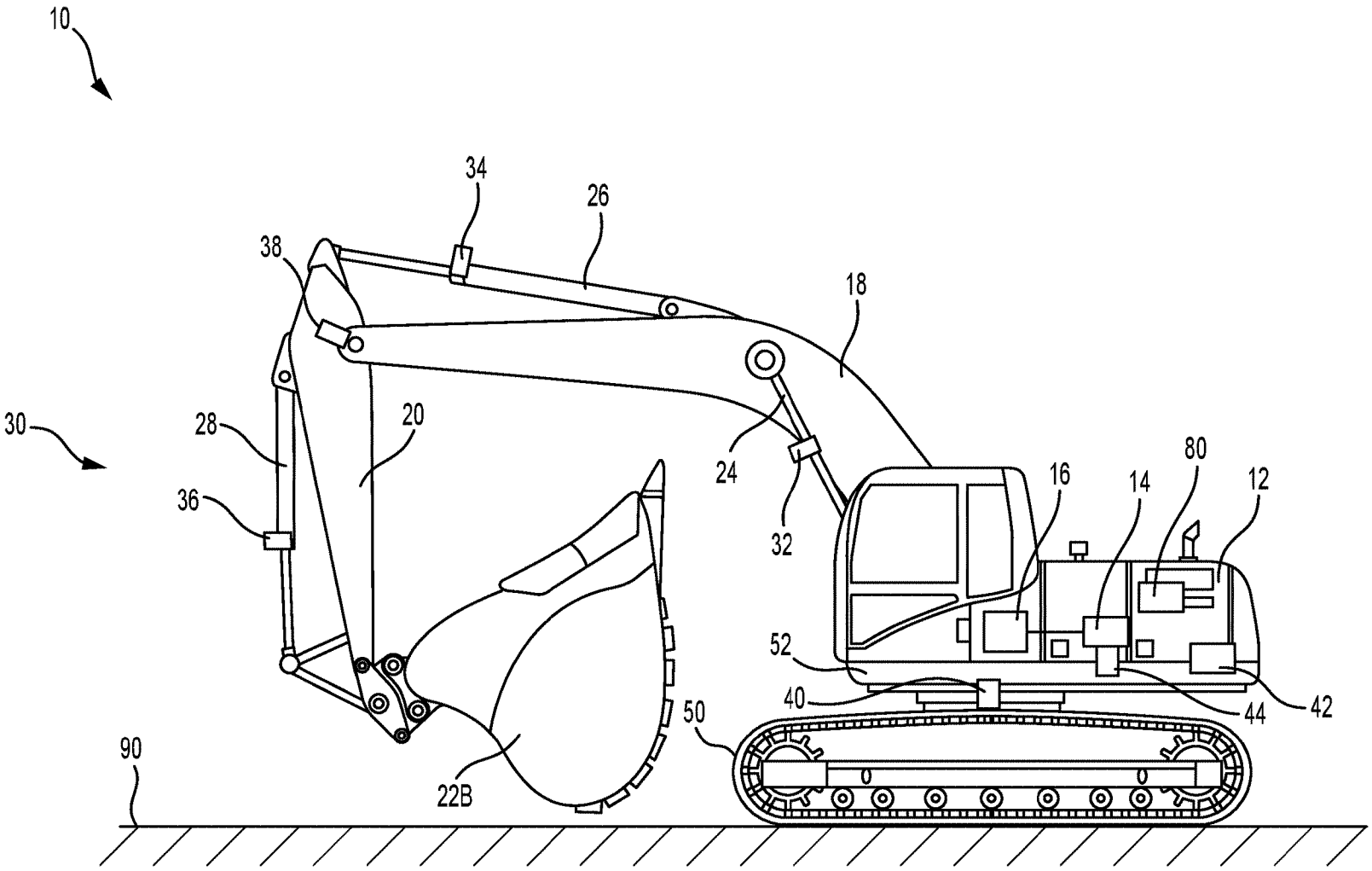
FIG. 2B is a partially-schematic side view of the machine in the posture of FIG. 2A, with an improper implement installed on the machine.

Improper implement detection module 82 includes, in at least some configurations, an acceptable implement characteristics dataset that includes data identifying a particular maximum pressure threshold that is associated with the posture and/or the movement being performed. The information included in the characteristics dataset may be associated with dimensions of each appropriate-sized implement 22A (FIGS. 1A and 2A). If desired, the maximum pressure threshold represents the expected pressure that would be exceeded when an improper implement 22B (FIGS. 1B and 2B) is installed. Further, a minimum pressure threshold may be included in the acceptable implement characteristics dataset, this minimum pressure threshold representing a lowest expected pressure for a particular posture or movement of machine 12 when a suitable implement 22A is present. A pressure below the minimum pressure threshold may indicate, for example, that the installed implement is underweight and designed for performing tasks for which the machine is not designed, or that no implement is installed. The maximum and minimum pressure thresholds may represent a range of pressures such that pressures within this range are expected during operation of machine 12 and associated with installation of an appropriate implement 22A. Therefore, installation of improper implement 22B may be associated with: detected pressures that, at times, exceed a corresponding maximum pressure threshold, or detected pressures that, at times, are below a corresponding minimum pressure threshold.

The maximum pressure threshold may be applicable to postures in which an implement is installed, the implement is empty, and the implement is not in contact with the ground, as shown in FIGS. 2A and 2B. In some examples, this threshold may be associated with the heaviest suitable implement 22A, such that installation of an overweight implement 22B causes the detected pressure to exceed the maximum pressure threshold when implement 22B is in the air.

A minimum pressure threshold may be applicable to postures in which implement 22A or 22B is expected to be in contact with ground 90, as shown in FIG. 1A. Sensed pressure may drop below this minimum when a suitable implement 22A contacts the ground in one of a plurality of expected postures associated with different suitable implement 22A. However, a pressure below the minimum pressure threshold may be observed when machine 12 is in the posture illustrated in FIG. 1B, due to the installation of an oversized implement 22B.

Another minimum pressure threshold may be applicable when implement 22A or 22B is expected to be above ground 90. Installation of improper implement 22B may be associated with pressures below the first or second minimum pressure thresholds.

In another example, a minimum pressure threshold may be associated with the lowest pressure that would be expected when performing a particular task. In the case of an excavator, when the implement curls to engage ground 90, hydraulic pressure will tend to increase. However, if an implement other than a bucket is installed, this motion may occur without the implement contacting ground 90, resulting in pressure that remains below the corresponding threshold.

The worksite information module may represent information related to the worksite at which machine 12 operates. For example, the worksite information may include a map of the worksite and may indicate the height of the ground 90 or other terrain for the location of machine 12. This information may be retrieved based on a geographic location of machine 12 measured with a positioning system, such as a global navigation satellite system receiver, enabling terrain information for the geographic location of machine 12 to be retrieved from ECM 80 or from one or more remote systems. This information may be used to correlate a maximum pressure or a minimum pressure with the posture of machine 12 based on the height of the ground 90.

Implement controller 84 may generate commands for adjusting the operation of pumps 14 and valves 16. These commands may control the pressurization and flow of hydraulic fluid for cylinders 24, 26, and 28, the flow of fluid changing the position of boom 18, stick 20, and implement 22A or 22B, respectively.

Outputs 110 may be generated by ECM 80 (e.g., with module 82 or controller 84) to display notifications and/or for taking other action when an improper implement is detected. Outputs 110 from ECM 80 may include a notification 122 for backend system 120 and/or a notification 132 for on-machine control system 130. Outputs 110 may also include commands (not shown) from implement controller 84. These commands may allow implement controller 84 to modify the position of the implement.

Notifications 122 and 132 may provide information to a supervisor of machine 12 or a supervisor for a worksite or fleet of machines 12, via backend system 120, or an operator of machine 12, via on-machine control system 130. Notifications 122 may indicate that a particular machine 12 has an improper implement 22B installed or is suspected of having an improper implement 22B installed. Notification 122 may include information identifying the machine (e.g., location, machine type, current operator) and may indicate that the currently-installed implement is oversized, overweight, underweight, undersized, or otherwise improper. Notification 132 may indicate that an improper implement 22B is installed, may include a warning, and may indicate that one or more functions of machine 12 (e.g., movement of implement 22B outside of a limited range) is disabled due to the presence of improper implement 22B.

INDUSTRIAL APPLICABILITY

System 10 may be useful in any machine in which an implement can be installed and replaced. For example, system 10 may be used in an earthmoving machine, paving machine, drilling machine, or other type of machine. System 10 may include components on one machine (e.g., sensor system 30, ECM 80, and on-machine control system 130), or may include one or more off-machine components (e.g., backend system 120). During the operation of system 10, machine 12 may perform work with an installed implement, such as implement 22A or 22B, while improper implement detection module 82 monitors the status of the implement in an automated manner. If desired, improper implement detection module 82 may operate without the need for user interaction and without the need for the user to place the implement 22A or 22B in a particular position. Rather, module 82 monitors various postures of machine 12 and monitors pressures to determine if one or more sensed pressures exceeds a maximum pressure threshold or drops below a minimum pressure threshold. Alternatively, improper implement detection module 82 may be enabled when an operator of machine 12 or a user of on-machine control system 130 enters a mode for monitoring implement status and detecting installation of an improper implement.

With reference to an earthmoving machine as shown in FIGS. 1A-2B, during operation of system 10, machine 12 may perform tasks including moving material, loading a hauling machine, or other tasks associated with earthmoving, paving, mining, etc. System 10 may monitor the condition of implement 22A or 22B continuously during the operation of machine 12, intermittently (e.g., in response to a request received from an operator or from a supervisor), and/or during startup or shutdown of machine 12. An example of monitoring the condition of implement 22A or 22B is described below with respect to FIG. 4.

Figure 4:
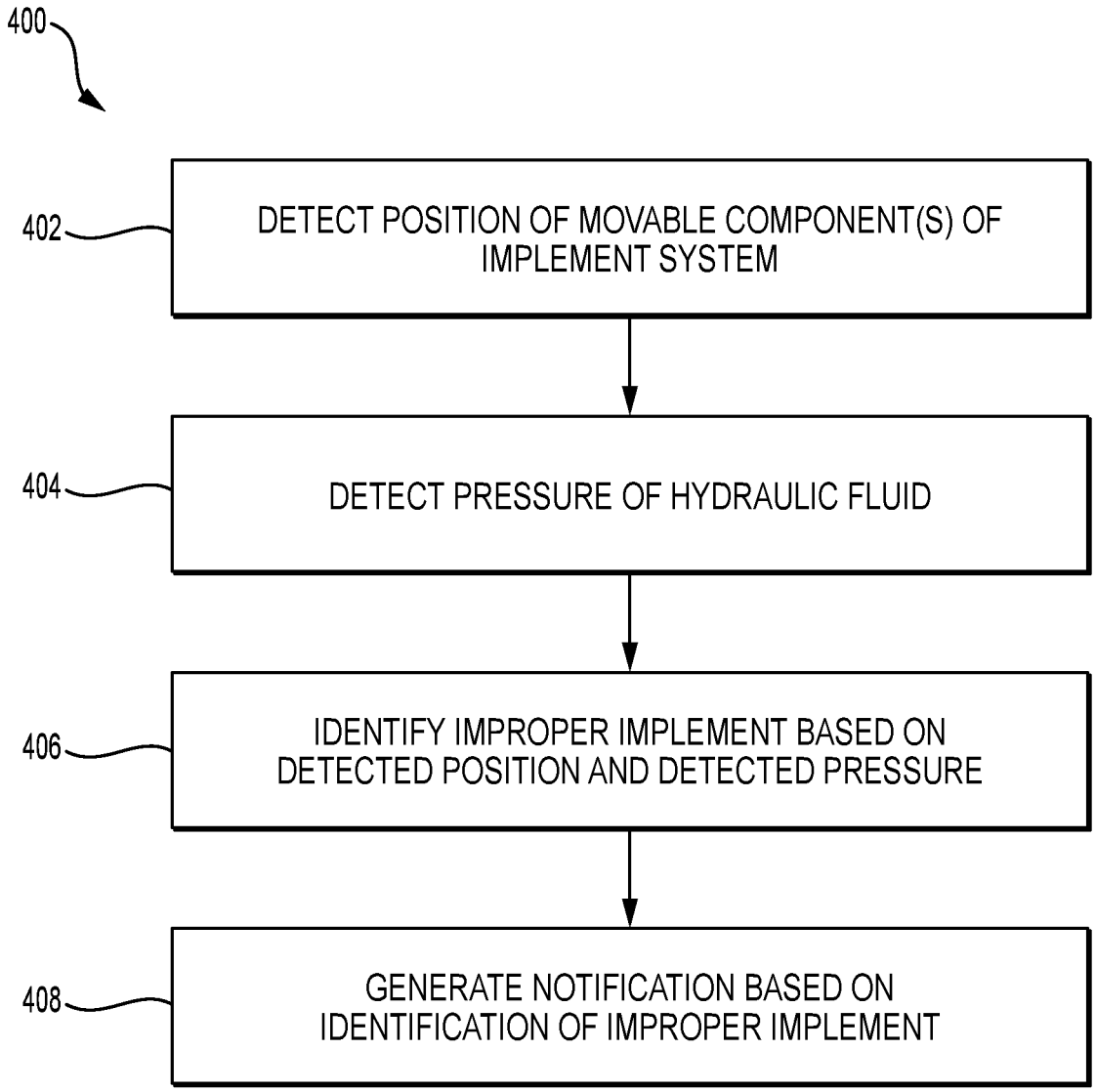
FIG. 4 is a flowchart of an exemplary method for identifying installation of an improper implement, according to aspects of the disclosure.

FIG. 4 is a flowchart illustrating an exemplary method 400 for identifying the installation of an improper implement on a machine, such as implement 22B installed on machine 12, as shown in FIGS. 1B and 2B. While steps 402-408 of method 400 are shown and described in a particular order, as understood, one or more of steps 402-408 may be performed in a different order and/or in a partially or entirely overlapping manner. In at least some aspects, method 400 may be performed without the need to discontinue work or position the implement 22A or 22B in a specific position. Rather, method 400 may be performed as a "background" process that monitors for an improper implement while an operator performs work with machine 12.

A step 402 may include detecting a position of one or more movable components of machine 12, such as links or other structures of an implement system. Step 402 may include, with ECM 80, detecting a position of an end of stick 20 or other location that corresponds to the installation location of implement 22B. During step 402, the posture calculator of detection module 82 may receive position signals from one or more of sensors 32, 34, 36, 38, and 40. Based on this, angles of each moving link, such as boom 18 and stick 20 may be determined. The posture may indicate whether implement 22A or 22B is expected to be in contact with the ground 90. If desired, expected contact between implement 22A or 22B with ground 90 may also be determined based on information from the worksite information module of detection module 82.

A step 404 may include detecting a pressure of hydraulic fluid with ECM 80. This may be performed by receiving signals from one or more pressure sensors, which may include sensors 32, 34, 36, and/or 44. If desired, flow rates of hydraulic fluid may also be detected in step 404. The pressure or flow of hydraulic fluid may correspond to an instantaneous measurement with changes in this pressure or flow rate being monitored and/or logged over time.

A step 406 may include identifying an improper implement based on the position and pressure that were determined, respectively, in steps 402 and 404. Step 406 may include correlating a current or past posture of machine 12 with pressure measurements made at a time that corresponds with this current or past posture.

As an example, step 406 includes determining whether a current posture of machine 12 is expected to place implement 22A or 22B above ground 90 or in contact with ground 90. A maximum pressure threshold or a minimum pressure threshold may be retrieved based on whether implement 22A or 22B is expected to be above the ground or in contact with the ground. In some aspects, the maximum or minimum pressure threshold may be correlated with movement, and in particular, with a type of task associated with movements performed with links connected to implement 22A or 22B.

As described above, first posture (FIG. 1A) where the implement is expected to be in contact with the ground may be associated with a first minimum pressure threshold, a first maximum pressure threshold, or both of these pressure value. A second posture (FIG. 1B) where the implement is expected to be above the ground (e.g., in partial contact with ground 90) may be associated with a second minimum pressure threshold, a second maximum pressure threshold, or both. The value of the first minimum pressure threshold may be smaller than the value of the second minimum pressure threshold, as the implement is expected to be in contact with the ground when in the first posture, but above the ground in the second posture. The value of the first maximum pressure threshold may be greater than the value of the second maximum pressure threshold as the implement is expected to be in contact with the ground when in the first posture (FIG. 1A) and above the ground when in the second posture (FIG. 1B).

In additional examples, a third posture (FIG. 2A) of machine 12 may be associated with a task, such as raising implement 22A after material has been unloaded. A fourth posture (FIG. 2B) illustrates machine 12 while raising oversized implement 22B. A fifth posture (not shown) may be associated with curling the implement to engage and scoop material, such as material of ground 90. As can be seen in FIGS. 1B and 2B, the third and fourth posture are identical, the only difference being the size of implement 22B as compared to implement 22A. This posture and/or the action of lifting the implement may be associated with a maximum movement pressure threshold, or a maximum average pressure threshold corresponding to a plurality of pressure measurements taken over the course of the act of lifting implement 22A or 22B, or performing a particular movement. The presence of implement 22B may cause the detected pressure to exceed the maximum movement pressure or the maximum average movement pressure.

Based on the detection of an extreme pressure, a pressure that exceeds one or more of the above-described maximum pressure thresholds or is less than the above-described minimum pressure thresholds, improper implement detection module 82 may identify the possibility that an oversized and/or overweight implement 22B is currently installed. In instances where this possibility has been determined once, module 82 may record (e.g., in a log) the occurrence. When the number of occurrences exceeds a predetermined threshold number, ECM 80 may generate a notification 122 and/or notification 132 in a step 408. In at least some examples, an oversized or overweight implement may be identified, and notification 122 or 132 generated, in response to the first occurrence of pressure above the maximum or below the minimum pressure.

In at least some aspects, step 402 is optional and may be omitted. This may be performed by identifying, in step 406, an extreme pressure that indicates an oversized and overweight implement 22B. The pressure correlator of improper implement detection module 82 may compare one or more detected pressures with a high maximum pressure threshold that is not expected to be exceeded during normal operation.

In some aspects, notification 122 and/or 132 may prompt an operator or supervisor to confirm the installation of implement 22A and 22B. For example, notification 122, 132 may state "Confirm Tool—Is Tool Incorrect or Damaged?" In addition to a notification 122, 132, step 408 may include restricting commands issued by implement controller 84. For example, controller 84 may limit the maximum permitted acceleration, velocity, payload, or other characteristics of the installed implement, and generate commands in accordance with these limits. As another example, implement controller may limit movement of implement 22B to movements within a limited range of motion.

System 10 and method 400 may enable the determination that an improper implement has been installed in a manner that is non-intrusive and accurate. This determination may be made without the need to install additional sensors, such as cameras or other vision sensors, reducing cost and complexity. Implements that are overweight, underweight, oversized, and/or undersized can be detected, this detection triggering an alert or other notification to the operator of the machine or a supervisor or fleet manager. If desired, continued operation of the implement can be limited or suspended, avoiding potential machine damage and reducing risk. Further, the sensors can be internal to the frame of the machine or otherwise tamper-resistant, helping to ensure continued operation of the monitoring system. The use of position sensors and/or pressure sensors facilitate the detection of an improper implement during various types of postures and tasks, improving reliability, especially in embodiments in which an improper implement is detected under multiple types of operating conditions.

It will be apparent to those skilled in the art that various modifications and variations can be made to the disclosed system and method without departing from the scope of the disclosure. Other embodiments of the system and method will be apparent to those skilled in the art from consideration of the specification and system and method disclosed herein. It is intended that the specification and examples be considered as exemplary only, with a true scope of the disclosure being indicated by the following claims and their equivalents.

What is claimed is:

1. A system for identifying an improper implement on a machine, the system comprising:

a machine configured for performing one or more tasks, the machine including:

a movable link configured to change a position of an implement installed on the machine;

a hydraulic system for moving the link, the hydraulic system including a hydraulic valve and a hydraulic pump; and a pressure sensor configured to detect a pressure of hydraulic fluid for the hydraulic system and output a signal according to the detected pressure; and a controller configured to:

receive the signal from the pressure sensor, determine that the implement is improper for the machine on which the implement is installed due to the implement being oversized, overweight, undersized, or underweight, based on the signal from the pressure sensor and based on the position of the implement, and generate a notification in response to determining that the implement is improper.

2. The system of claim 1, wherein the controller is configured to determine that the implement is improper based on signals from a plurality of sensors, each of the sensors being a non-vision sensor.

3. The system of claim 1, wherein the controller is further configured to determine a height of the ground and determine that the implement is improper based on the determined height of the ground and the position of the link.

4. The system of claim 1, further including a position sensor, the controller being configured to determine the position of the implement based on a signal from the position sensor.

5. The system of claim 4, wherein the controller is further configured to determine that the implement is improper when a pressure measured with the pressure sensor is greater than a pressure threshold when the implement is located at the position determined by the controller based on the signal from the position sensor.

6. The system of claim 1, wherein the controller is configured to determine that the implement is improper for the machine on which the implement is installed further based on signals from a swing sensor or from an engine speed sensor.

7. The system of claim 1, wherein the controller is configured:

to determine when the implement is oversized, to determine when the implement is overweight, to determine when the implement is undersized, and to determine when the implement is underweight, the controller being further configured to:

determine that the implement is improper based on comparing a detected pressure with a pressure threshold, the pressure threshold being associated with a posture of the machine.

8. A detection system configured to determine presence of an improper implement on a machine, the system comprising:

a pressure sensor configured to detect a pressure of hydraulic fluid for controlling an implement and output a signal indicative of the pressure; and a controller configured to:

receive the signal from the pressure sensor, determine that the implement is improper for the machine on which the implement is installed due to the implement being oversized, overweight, or oversized and overweight, based on the signal from the pressure sensor, and generate a notification in response to determining that the implement is improper.

9. The system of claim 8, wherein the controller is configured to determine that the implement is improper further based on a detected position of the implement.

10. The system of claim 8, wherein the controller is configured to determine that the implement is improper when the signal indicates that the pressure of hydraulic fluid exceeds a maximum pressure threshold that is associated with a posture of the machine or with a movement of the machine.

11. The system of claim 8, wherein the controller is configured to generate the notification when the pressure of hydraulic fluid has exceeded a maximum pressure threshold more often than a threshold number of occurrences.

12. The system of claim 8, wherein the controller is configured to perform the determination that the implement is improper based on the pressure of the hydraulic fluid sensed while the implement is in contact with the ground.

13. The system of claim 8, wherein the controller is configured to determine that the implement is improper by receiving the signal while the implement is not in contact with the ground.

14. A method for identifying installation of an improper implement on a machine, the method comprising:

detecting a position of a movable link for positioning an implement with a position sensor;

determining a position of the implement based on the position of the movable link;

detecting a pressure of hydraulic fluid, flow of the hydraulic fluid being controlled for positioning the implement; and based on the determined position of the implement and the detected pressure, identifying that the installed implement is improper for the machine on which the implement is installed.

15. The method of claim 14, further including comparing the detected pressure of hydraulic fluid to an expected hydraulic fluid pressure associated with the position of the implement.

16. The method of claim 15, wherein the position of the implement is a position in which the implement is expected to be above the ground.

17. The method of claim 16, wherein the improper implement is identified based on the detected pressure being less than the expected hydraulic fluid pressure.

18. The method of claim 15, wherein the position of the implement is a position in which the implement is expected to be in contact with the ground.

19. The method of claim 14, wherein the improper implement is identified without the use of a vision-based sensor.

20. The method of claim 14, further including generating a notification in response to identifying the improper implement, the notification indicating presence of the improper implement.

* * * * *